US005540431A

United States Patent [19]

Crozier

[11] Patent Number: 5,540,431

[45] Date of Patent: Jul. 30, 1996

[54] ANTI-SPILL GOLF-CARRYBAG W/AUTODEPLOY-BIPOD

[76] Inventor: Robert L. Crozier, 1235 #Ph.-F) Parker Pl., San Diego, Calif. 92109

[21] Appl. No.: 297,380

[22] Filed: Aug. 29, 1994

[51] Int. Cl.[6] ..... A63B 55/00

[52] U.S. Cl. ..... 473/282; 248/96; 248/95; 248/97; 248/98; 206/315.3

[58] Field of Search ..... 248/136, 96; 206/315.7, 206/315.4, 315.3, 240; 273/32 E; 150/1.5

[56] References Cited

U.S. PATENT DOCUMENTS

| | | | |
|---|---|---|---|
| 4,078,594 | 3/1978 | Oeckel | 206/315.4 |
| 4,921,192 | 5/1990 | Jones | 248/96 |
| 5,303,888 | 4/1994 | Seop | 248/96 |

FOREIGN PATENT DOCUMENTS

| | | | |
|---|---|---|---|
| 365226 | 1/1932 | United Kingdom | 206/315.3 |

*Primary Examiner*—Vincent Millin

*Assistant Examiner*—Charles W. Anderson

[57] ABSTRACT

A golfclub-case preferably employed in nature of a lighter carrybag embodiment, features a telescopically variable advantage; whereby the golfer is provided a more comfortably balanced effect during carry-modality, yet more convenient access during freestanding-modality. The special golfclub-case structure comprises two tubular sections freely sliding one inside the other, plus a shoulder-sling secured at one end to the upper opened-end of the golfclub-case, the oposite end down near the case's basecup. Thus when rested upon the base, the case telescopically-retracts about 4-inches, facilitating better upper-end access to shorter putter and wedge type clubs; yet-when lifted away for resumption of carrying, weight of golfclubs automatically re-extends case length, thus effectively shifting center-of-gravity more aft of one's shoulder than with a conventional case, thereby negating former aggravating tendancy of golfclubs to spill out forward as one moves about. An optional stand provision engages the telescopic action, auto-deploying bipod-legs as the golfcase is staged upon the turf, auto-retracting the bipod when lifted away.

11 Claims, 1 Drawing Sheet

A.
B.

ANTI-SPILL GOLF-CARRYBAG W/AUTODEPLOY-BIPOD

PROBLEMATICAL BACKGROUND OF RELEVANT EARLIER INVENTION

This invention relates to golfbags offering improved spill-resistant balance during shoulder carrying, the actuating means employing weight of the golfclubs; and more specifically, it relates to auto-deploy/auto-retract bipod-legs for oblique support of the golfbag upon the grass turf.

Heretofore, it has been a known problem that many golfbags achieve only a very tenuous degree of balance while the golfbag is being carried via strap slung over one's shoulder. The center-of-gravity balance of the golfbag being often increasingly destabilized with the accumulation of additional heavy headed clubs being carried within, but extending forward for the golfbag. Background research discovery provides some prior patent-art regarded as germane to this disclosure, for example U.S. Pat. No. 5,303,888 (filed: April 4, 1994) contemplates a golfbag having bipod-legs which are automatically extended from the body of the golfbag by virtue of the weight of the golfclubs being borne from within the golfbag. As the golfbag is manually repositioned vertically from the near horizontal carry position, the full weight brunt of the contained golfclubs thus comes to bear down (via natural force of gravity) upon the special weight-sensitive linkage actuating apparatus located within the confines of the cylindrically rigid fixed-length golfbag, thereby causing the bipod-legs to extend for conveniently supporting the golfbag resting inclined about 30-degrees (from vertical) upon the grass turf. Conversely, when the golfbag is lifted away via the carry-handle or the shoulder carry-strap, the near horizontal carry attitude thus assumed acts to relieve much of the golfclubs weight brunt, resulting in insufficient gravity-force to maintain the bipod-legs extended, and the legs thus automatically bias retractably against the golfbag's exterior wall. However, an inherently defective characteristic of this golfbag's actuating-mechanism resides in the positional condition of the golfclubs when the golfbag is tipped toward a more nearly horizontal carry attitude, whereby the golfclubs actually shift (lift) slightly forward (outward) of the golfbag's aperture end. This weight-shift bias thus tends to aggravate an already slightly unstable carry condition, wherein excessive golfclub head-weight projecting to far forward relative to one's shoulder can result in the golfbag's club content being spilled out (seemingly to most user's and their golfing partners as a mere clumsy accident) forward upon the ground.

It should also be noted, that in many other patented golfbags having articulated bipod-legs, such as typical of U.S. Pat. Nos. 5,152,483, 5,156,366, 5,178,273, 5,236,085, the actuating mechanism embodies a ground impinging "toe" of such small surface-area (footprint), that in many instances the toe simply penetrates down into the tiny surface undulations of the grassy golfcourse, thus failing to actuate the bipod deploy mechanism until the entire assembly is necessarily lifted away to a location which does finally operate the toe actuator device.

Therefore, in full consideration of the preceding patent analysis, there is determined a need for an improved form of device to which the patent has been largely addressed. The instant inventor hereof believes their newly improved device, commercially referred to as the NoSpill-golfbag currently being developed for production under auspices of the BuddyBag Mfg/Mkt. Co., exhibits certain advantages as shall be revealed in the subsequent portion of this instant disclosure.

SUMMARY OF THE INVENTION

A.) In view of the foregoing discussion about the earlier invention art, it is therefore important to make it pellucid to others interested in the art that an object of this invention is to provide a golfbag and preferably a lighter-weight golfbag comprised essentially of two preferably plastic tubular sections, one of which tubular members slides telescopically concentric within the other. The functional purpose of the first and second cooperating tubular-sections being to facilitate telescopic expansion or contraction of the golfbag along it's longitudinal-axis for advantage of anti-spill performance by virtue of shifting of the golfbag's contained weight-mass C.G.(center-of-gravity) aftward while being carried expanded via tension applied to the uppermost portion of the shoulder-strap; and alternately, more convenient access to shorter golfclubs when the case is rested in contracted-modality upon the ground.

B.) Another object of this invention disclosure is to set forth an article wherein is provided a special golfbag preferably executed in the embodiment of a light-weight golfbag, featuring bipod-legs having convenient auto-deploy(extend) and auto-retract operating modalities. Moreover, it is intended the structure given in preceding item-A be employed to provide the desired automatic operation by physically coupling the upper-terminuses of the bipod-legs jointedly to the upper distal region of one given upper/tubular-section, the lower-terminuses of bipod-leg's linkarms (or at least one double-acting linkarm) jointedly to the body of the cooperating lower/tubular-section, and the upper-terminuses of the bipod-legs' linkarms to the bipod-legs.

C.) Another object of this invention disclosure is to set forth an article wherein is provided a special golfbag preferably executed in the embodiment of a lighter-weight golfbag according to preceding item-A, wherein the upper/tubular-section component provide the primary accessible aperture and preferably be of smaller rigid outside-diameter (od) so as to provide the specified slip-fit relationship into the inside-diameter (id) of the lower/tubular-section component having a ruggedly occluded base-cup. This arrangement is an optional arrangement, an alternate generic-variant design choice being to have the upper/tubular-section component fit outside, and the lower/tubular-section component then telescopically slip inside thereto. Either arrangement to include a common telescopic expansion/contraction travel limitation provision, such as via the natural accordion-pleat like compression and tension characteristics of the fabric like external covering bridging across the relative moving surfaces of the cooperating tubular-sections. Alternately, particularly where the tubular-case is made of extruded-plastic tubes which employ no outer fabric-covering, the travel limiting provision is to be facilitated by at least one impingement member provided on one tubular-section, which impinges upon predetermined travel abutment limits provided on the other said tubular-section; thereby ultimately checking (max./min.) relative linear-motion of the two cooperating tubular-sections.

DESCRIPTION OF THE PREFERRED EMBODIMENT DRAWINGS

The foregoing and still other objects of this invention will become fully apparent, along with various advantages and features of novelty residing in the present embodiments, from study of the following description of the variant generic species embodiments and study of the ensuing description of these embodiments. Wherein indicia of reference are shown to match related matter stated in the text, as well as the claims section annexed hereto; and accordingly, a better understanding of the invention and the variant uses is intended, by reference to the drawings, which are considered as primarily exemplary and not to be therefore construed a restrictive in nature.

Figures 1, 2, 3, 4A, 4B, 5:
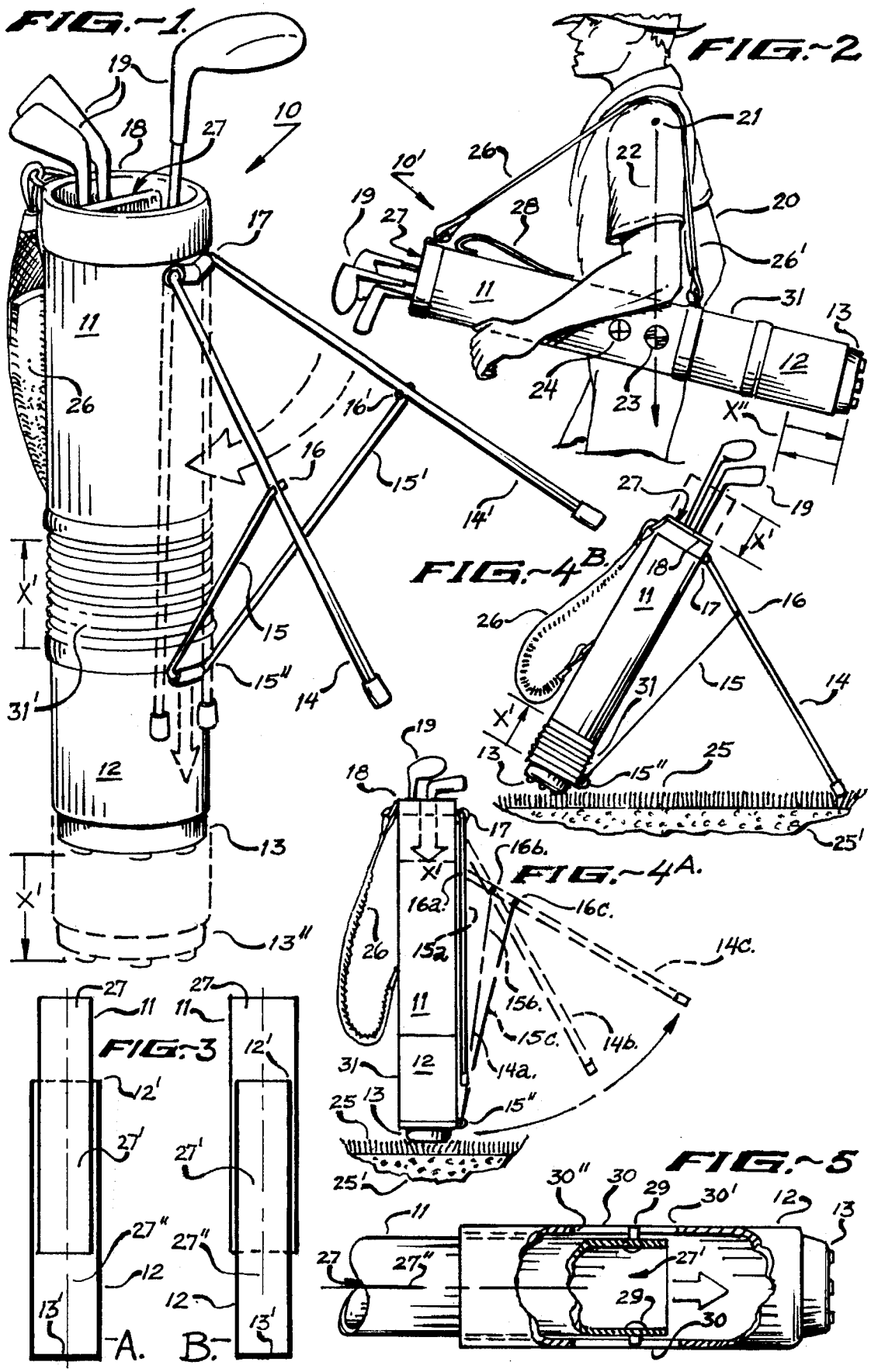
FIG. 1, is a pictorial perspective-view, favoring the frontal upper-left portion of the invention, including operational action indicated via phantom-outline.
FIG. 2, is a side-elevation cross-sectional view, including phantom-outline portions thereto demonstrating physical action movement.
FIG. 3, is a diagrammatic cross-sectional side/elevation-view, demonstrating the two basic structural embodiments of the invention.

FIG. 4A/B, is a semi-diagrammatic side-elevation-view demonstrating in phantom-outline how the relative linear-motions of the two tubular-sections cooperate;

FIG. 5, is a cross-sectional side-view, showing a generic-variant embodiment.

ITEMIZED NOMENCLATURE REFERENCES

10/10'—overall golfbag (with bipod-legs/without bipod-legs)

11—upper/tubular-section

12,12'—lower/tubular-section, ledge

13/13',13"—base-cup (exterior/interior), extended position

**14/14',14*abc***—bipod-legs (left/right), three sequential positions

**15/15',15",15*abc***—linkarms (left/right), lower pivot-joint, sequential positions

**16/16',16*abc***—pivot-joints (left/right), sequential positions

17—bipod-legs pivot-joint

18—rim of golfbag aperture

19—existing golfclubs

20—golfing-person

21—left shoulder-joint

22—vertical gravity-vector ref. arrow

23—proximal CG of new golfbag

24—proximal CG of conventional golfbag

25—grass turf, earth

26/26'—carry-strap (forward-upper portion/aftward-lower portion)

27,27',27"—golfbag aperture, golfbag internal confines, longitudinal-axis

28—auxiliary handle

29—rivet-lug or equivalent impingement member

30,30'/30"—linear-slot, contracted/expanded abutment limits

31/31'—exterior fabric (tension-expanded/accordion-contracted)

DETAILED DESCRIPTION OF THE PREFERRED EMBODIMENTS

Initial reference is given by way of FIG. 1, wherein is exhibited a presently most preferred embodiment of the invention in the form of a lightweight golfbag 10 having an upper/tubular-section 11 which is telescopically cooperational with a lower/tubular-section 12. In addition to other functional advantages set forth herein, the exceptional footprint-area provided by virtue of the base-cup 13 bearing upon the grassy turf surface 25, assures consistently positive operation of the bipod-legs 14/14'; in that the entire base-cup 13 in effect advantageously serves as the impinging device, which cannot become impelled down through the turf 25 (Note—the small turf impinging devices of previous golfbags can actually poke down through the turf into the ground 25' often resulting in non-deployment of their bipod-legs).

In FIG. 2 a Golfer-person 20 is shown carrying the basis version of the invention(not bipod-leg supported) over their shoulder(note shoulder-joint 21) in a generally normal walking attitude, and wherein advantage of the telescopic capability alone is demonstrated. Comparison of the relative proximal CG(center-of-gravity) balance points 23 and 24(conventional) reveals how the new balance-point 23 provided by this invention enables a significantly improved resistance to golfclub spillage. Since the average golfbag is about 34-inches in length as measured along the longitudinal-axis 27" (Ref. FIG. 3), the telescopic-golfbag of FIG. 2 is shown fully extended to about 36-inches length, which added length acts to reposition the existing golfclubs 19 aftward a couple of inches, thereby effectively placing the golfclubs rearward of the vertical (perpendicular to ground) gravity-vector arrow-ref.line 22, so as to thereby exhibit less tendency toward inadvertent forward spillage of the golfclubs 19. Reference-arrow X" of FIG. 2 indicates the telescopic range of adjustment which occurs automatically in the most preferred embodiments of the invention, whenever the golfbag 10' is lifted or carried via the forward portion of the carry-strap 26 or by the auxiliary handle 28 (but never via the aftward portion of the carry-strap 26').

Further example is given in FIG's. 4-A/B, wherein a variant of the invention having bipod-legs 14 is shown in FIG. 4 with it's base-cup 13 initially resting flat upon the grass turf 25, whereby the upper/tubular-section is being manually lowered(via ref.arrow-X') to a length of only 31-inches by simply pushing down upon the upper/tubular-section 11. A graphic three-sequence action is indicated in FIG. 4A, whereby fully retracted bipod-leg **14*a* is biased outward partially to position 14*b* as upper/tubular-section 11 is only partially lowered, and finally to position 14*c* as the golfbag is fully biased to the most telescopically contracted position. If this were the generic embodiment of FIG. 2 the only grounded(unslung) function of the contracted modality would have been to give improved access to the golfbag confines via aperture 27; however, FIG. 4B serves to demonstrate the final resting attitude of the golfbag on it's bipod-legs 14 as well. Note also in FIG's. 4A/B how the linkarm 15 is jointed both at 15" on the lower/tubular-section 12, and jointed also into the bipod-leg 14 at point 16, thereby urging the bipod-leg 14 either in or out according to the upper/tubular-section 11 being biased either up or down respectively. In FIG's. 4A/B** the linkarm is indicated only in it's most extended position, thus one is given to understand that the simple geometric-kinematics is such that when the bipod-legs are fully retracted so are their respective linkarms.

The diagrammatic study of FIG. 3A/B reveals how the upper/tubular-section 11 may be constructed according to FIG. 3A to easily slide either concentric of the ID(inside-diameter) of lower/tubular-section 12; or conversely according to FIG. 3B, lower/tubular-section 12 may be arranged to easily slide concentric to the ID of externally arranged upper/tubular-section 12. Presently, the most preferred arrangement is that of FIG. 3A, since in this configuration there is no problematical ledge 12' (FIG. 3B) upon which the golfclubs can inadvertently abut upon when the Golf-player carelessly sends a golfclub into the golfbag confines 27'. Additionally, the bottom-end space of version FIG. 3A is more conducive to accommodating a greater number of clustered golfclubs than the slightly more confined cross-sectional width exhibited in FIG. 3B. Note also, that while the golfbag of this invention is preferably circular in transverse cross-section, it could as well be oval-shaped in cross-section if desired for example.

Reference to FIG. 5 shows an alternate manner of construction, whereby instead of the two telescopic tubular-sections being fabricated from rolled sheet-plastic such as 0.063"-gauge polyethylene which is longitudinally line-stitched, ultrasonically line-fused, or line-riveted together, the two sections are simply extruded without seams. This lends to even further economy of construction, whereby reliance upon external fabric 31' of FIG. 1 for example, may be obviated. Instead of employing this exterior fabric in natural self-induced accordion-pleat like compression 31' and recovered(non-accordioned) tension 31(ref.example FIG. 2) to achieve minimum and maximum telescopic travel limitations (ref.arrow-X of FIG. 1), the more mechanical exemplified arrangement of an impingement member 29 provided on one tubular-section, which is given to impinge upon predetermined travel abutment limits 30'(contracted) and 30"(expanded provided upon lower/tubular-section 12, thereby ultimately checking relative linear motion of the two cooperating tubular-sections to achieve equivalent longitudinal-axis expansion or contraction travel limitation. Regardless as to implementation, it is intended that the unique operating principle remain the same; that is to say when the contracted (ref.arrow-X') golfbag of FIG. 1 is lifted away via carrystrap 26 secured uppermost to upper/tubular-section 11, weight-mass of the golfbag's contained golfclubs 19 acts down upon base-cup 13 of the other lower/tubular-section 12, automatically biasing the golfbag back into expanded modality according to FIG. 2(ref.arrow-X"). Accordingly, if the golfbag includes the bipod-leg option, then retractional operation of the bipod-legs is just opposite to that demonstrated in FIG. 4A.

Thus it is readily understood how the preferred and generic-variant embodiments of this invention contemplate performing functions in a novel way not heretofore available nor realized. It is implicit that the utility of the foregoing adaptations of this invention are not necessarily dependent upon any prevailing invention patent; and, while the present invention has been well described hereinbefore by way of certain illustrated embodiments, it is to be expected that various changes, alternations, rearrangements, and obvious modifications may be resorted to by those skilled in the art to which it relates, without substantially departing from the implied spirit and scope of the instant invention. Therefore, the invention has been disclosed herein by way of example, and not as imposed limitation, while the appended claims set out the scope of the invention sought, and are to be construed as broadly as the terminology therein employed permits, reckoning that the invention verily comprehends every use of which it is susceptible. Accordingly, the embodiments of the invention in which an exclusive property or proprietary privilege is claimed, are defined as follows.

What is claimed of proprietary inventive origin is:

1. A special golfclub golfbag capable of automatically telescoping to provide advantageous C.G.-shift of the golfclubs contained weight-mass aftward while carried via shoulder-strap, and to provide more convenient access to shorter golfclubs when rested perpendicular upon ground; comprising:

concentric upper and lower cooperating tubular-sections facilitating intersliding expansion and contraction along a common longitudinal-axis;

said upper tubular-section portion providing said golfbag's primary access aperture and rigid upper structure;

said lower tubular-section portion providing said golfbag's occluded rigid lower structure and base portion;

said telescopic upper and lower tubular-section integrity including longitudinal expansion and contraction travel limitation means.

2. The invention apparatus according to claim 1, wherein said upper/tubular-section is arranged concentrically within said lower/tubular-section.

3. The invention apparatus according to claim 1, wherein said lower/tubular-section is arranged concentrically within said upper/tubular-section.

4. The invention apparatus according to claim 1, wherein said travel limiting means is provided by the natural accordion-pleat like compression and tension characteristics of the fabric like external covering bridging across the relative moving surfaces of said cooperating tubular-sections.

5. The invention apparatus according to claim 1, wherein said travel limiting means is facilitated by at least one impingement member provided on one said tubular-section, impinging upon predetermined travel abutment limits provided on other said tubular-section; thereby ultimately checking relative motion on said cooperating tubular-sections.

6. The invention apparatus according to claim 1, wherein is also included a special automatically actuated bipod-leg apparatus, said apparatus comprising a pair of bipod-legs jointed to the upper/tubular-section so that said bipod-legs splay apart for greater stabilization of said golfbag upon the ground when the bipod-legs are extended, and including at least one linkarm jointed to at it's lower-terminus to the lower/tubular-section, and jointed at it's upper-terminus to said bipod-legs; said bipod-legs thereby caused to deploy into said extended-modality when said tubular-sections become longitudinally contracted, and conversely said bipod-legs are caused to return to retracted-modality when said tubular-sections become longitudinally expanded.

7. A special golfclub golfbag capable of automatically telescoping to provide advantageous C.G.-shift of the golfbag's contained weight-mass aftward while carried via shoulder-strap, and to provide more convenient access to shorter golfclubs when rested perpendicular upon the ground, plus provision of automatically extending or retracting bipod-legs, said combination comprising:

concentric upper and lower cooperating tubular-sections facilitating intersliding expansion and contraction along a common longitudinal-axis;

said upper tubular-section portion providing said golfbag's primary access aperture and rigid upper structure;

said lower tubular-section portion providing said golfbag's occluded rigid lower structure and base portion;

said telescopic upper and lower tubular-section including longitudinal expansion and contraction travel limitation means;

a pair of bipod-legs jointed at their upper terminuses to said upper tubular-section so that the bipod-legs splay apart when in extended modality, and including at least one linkarm jointed at it's lower terminus to said lower tubular-section and jointed at it's upper terminus below said bipod-legs upper jointed terminuses;

said bipod-legs thereby caused to deploy into said extended-modality when said tubular-sections are longitudinally contracted, and conversely said bipod-legs are caused to return to their retracted-modality when said tubular-sections are longitudinally expanded.

8. The invention apparatus according to claim 7, wherein said upper/tubular-section is arranged concentrically within said lower/tubular-section.

9. The invention apparatus according to claim 7, wherein said lower/tubular-section is arranged concentrically within said upper/tubular-section.

10. The invention apparatus according to claim 7, wherein said travel limiting means is provided by the natural accordion-pleat like compression and tension characteristics of the fabric like external covering bridging across the relative moving surfaces of said cooperating tubular-sections.

11. The invention apparatus according to claim 7, wherein said travel limiting means is facilitated by at least one impingement member provided on one said tubular-section, impinging upon predetermined travel abutment limits provided on the other said tubular-section; thereby ultimately checking relative motion of said cooperating tubular-sections.

* * * * *